United States Patent [19]

Nishikawa et al.

[11] 4,342,972

[45] Aug. 3, 1982

[54] MICROWAVE DEVICE EMPLOYING COAXIAL RESONATOR

[75] Inventors: Toshio Nishikawa, Nagaokakyo; Youhei Ishikawa; Sadahiro Tamura, both of Kyoto; Haruo Matsumoto, Nagaokakyo, all of Japan

[73] Assignee: Murata Manufacturing Co., Ltd., Japan

[21] Appl. No.: 193,185

[22] Filed: Oct. 1, 1980

[30] Foreign Application Priority Data

Oct. 15, 1979 [JP] Japan ..... 54-133280

[51] Int. Cl.[3] ..... H01P 1/202; H01P 7/04; H01P 1/213

[52] U.S. Cl. ..... 333/206; 333/136; 333/222; 333/245

[58] Field of Search ..... 333/202, 206, 207, 222–226, 333/245, 132, 136

[56] References Cited

U.S. PATENT DOCUMENTS 4,151,494 4/1979 Nishikawa et al. ..... 333/206 X 4,268,809 5/1981 Makimoto et al. ..... 333/207 X

*Primary Examiner*—Marvin L. Nussbaum

*Attorney, Agent, or Firm*—Ostrolenk, Faber, Gerb & Soffen

[57] ABSTRACT

The disclosure relates to an improved microwave device which includes a casing of electrically conductive material, at least two coaxial resonators, for example, ¼ wavelength coaxial TEM resonators each having dielectric member disposed between an inner conductor and an outer conductor of the coaxial resonator and a terminal electrode secured in the inner conductor to provide a terminal portion projecting from an end face of each of the coaxial resonators. The resonators are accommodated in the casing so as to be electrically connected and mechanically secured to the casing. A dielectric plate member connecting input and output terminals of the device is provided at least two coupling electrodes spaced predetermined intervals from each other are provided on the dielectric plate member. The microwave device is arranged to obtain coupling electrostatic capacity mainly between the coupling electrodes provided on the main flat surface of the dielectric plate member.

14 Claims, 10 Drawing Figures

MICROWAVE DEVICE EMPLOYING COAXIAL RESONATOR

BACKGROUND OF THE INVENTION

The present invention generally relates to a microwave device and more particularly, to a microwave device such as an electrical filter, a branching filter or the like employing coaxial resonators, for example, transverse electro-magnetic mode coaxial resonators (referred to as TEM coaxial resonators hereinbelow) which have improved designs especially advantageous from the viewpoint of manufacture.

Generally, microwave devices utilizing coaxial resonators have been widely used in electrical and electronic equipment operating, for example, in VHF and UHF ranges.

For the electrical filters as described above, there has been proposed, for example, in U.S. Pat. No. 4,151,494 assigned to the assignee of the present invention, an electrical filter employing coaxial TEM resonators mainly for the purpose of reducing the filter size, etc. in accord with the recent trend to miniaturization of electrical and electronic equipment. But the known electrical filter as described above still has some problems to be solved with respect to its performance, and with respect to the efficiency of its manufacture.

Similarly, other microwave devices conventionally proposed also have certain disadvantages particularly in the complicated structures thereof with consequent large size, and are not necessarily suitable for mass production.

SUMMARY OF THE INVENTION

Accordingly, an essential object of the present invention is to provide a compact microwave device for use in electrical and electronic equipment which is stable in functioning and simple in construction.

Another important object of the present invention is to provide a microwave device of the above described type which will perform faithfully according to its design, with good reproducibility.

A further object of the present invention is to provide a microwave device of the above described type which can be produced on a large scale at low cost.

Yet a further object of the present invention is to provide an improved coaxial resonator for use in a microwave device of the above described type, the design of which facilitates connection with other parts and components, for use in compact microwave devices simple in construction and low in cost.

In accomplishing these and other objects, according to one preferred embodiment of the present invention, there is provided an improved microwave device which includes an electrically conductive housing means, at least two resonator means accommodated in and electrically connected and mechanically secured to the housing means. Each of the resonator means includes a dielectric member having a bore therein, an outer conductor member disposed on the outer periphery of the dielectric member and electrically connected to the housing means, an inner conductor member disposed on the periphery of the bore of the dielectric member, and a terminal electrode member secured to and in direct electrical contact with the inner conductor member, with one portion of the terminal electrode member projecting from one end of the resonator means. The microwave device further includes an input means for applying electrical signals to the microwave device, an output means for removing electrical signals from the microwave device, and a coupling means for electrically coupling the input means, resonator means and output means. The coupling means includes a dielectric coupling member connected between said input and output means and having thereon at least two coupling electrode layers which are spaced predetermined intervals from each other and to which the respective ones of the projecting terminal portions of the terminal electrode members are connected for mainly establishing an electrostatic capacitive coupling between the coupling electrode layers.

By the arrangement according to the present invention as described above, a compact microwave device simple in construction and suitable for massproduction has been advantageously presented at low cost, with substantial elimination of disadvantages inherent in the conventional microwave devices of this kind.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

In the first place, it is to be noted that the term "microwave device" in the present specification means electrical filters, branching filters and any other devices equipped with coaxial resonators.

Figure 1:
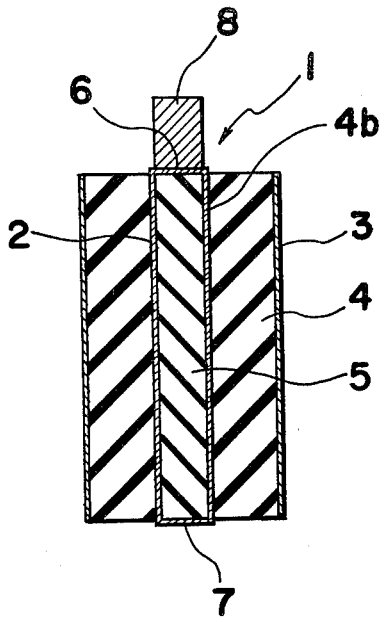
FIG. 1 is a sectional view of a ¼ wavelength coaxial TEM resonator which may be used in a branching filter according to the present invention.

Referring now to the drawings, there is shown in FIG. 1 a ¼ wavelength coaxial TEM resonator 1 which may be applied to a branching filter according to the present invention, which generally comprises an inner conductor 2, an outer conductor 3 and a dielectric member 4, for example, a ceramic dielectric member of the titanium oxide group filling the space between the cylindrical inner and outer conductors 2 and 3. More specifically, the resonator 1 includes the dielectric member 4 with an axial bore 4*b*, made of dielectric material of, for example, the titanium oxide group; the inner cylindrical conductor 2 formed on the inner cylindrical surface of the dielectric member 4 by an electrode forming method such as baking onto it an electrode forming material with superior high frequency conductivity and good adhesion with respect to the material of the dielectric member 4, for example, silver paste or the like, and the outer cylindrical conductor 3 formed on the outer cylindrical surface of the dielectric member 4, also by baking silver paste onto it or the like. The inner conductor 2 is provided with an axial bore into which is inserted, to be secured thereat, a central rod 5 of a ceramic material or the like similar to that of the dielectric member 4 and having the same length as said member 4, while the central rod 5 has its opposite end faces respectively covered with electrode films 6 and 7 which are integrally formed with the inner conductor 2. A terminal member 8 is bonded to the electrode film 6 by suitable means. It is to be noted that the terminal member 8 may instead be bonded to the electrode film 7.

Figure 2:
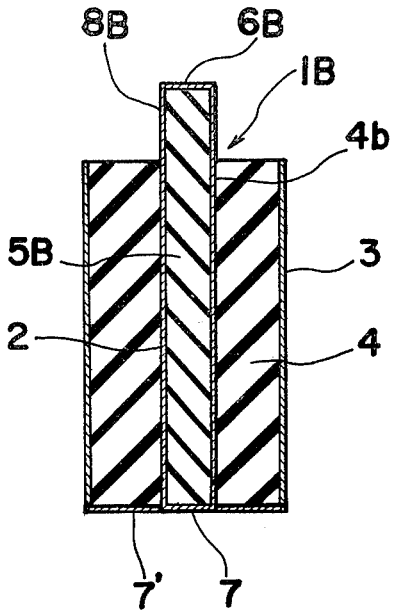
FIGS. 2 and 3 are views similar to FIG. 1, but particularly show modifications thereof.

Referring to FIG. 2, there is shown a modification of the ¼ wavelength coaxial TEM resonator 1 of FIG. 1. In the modified resonator 1B of FIG. 2, the terminal member 8 described as employed in the resonator 1 of FIG. 1 is dispensed with, and the central rod 5B of dielectric material has a length longer than that of the dielectric member 4 so that it projects from one end of the resonator 4 to a predetermined extent, with the projecting end 8B of the central rod 5B serves as a terminal portion, being covered by the electrode film 6B integrally formed with the inner conductor 2. It is to be noted here that the entire central rod 5B may be replaced by a rod of metallic material, or that the outer conductor 3 and inner conductor 2 may be short-circuited by an electrode 7' at the side of the electrode film 7 as shown.

Figure 3:
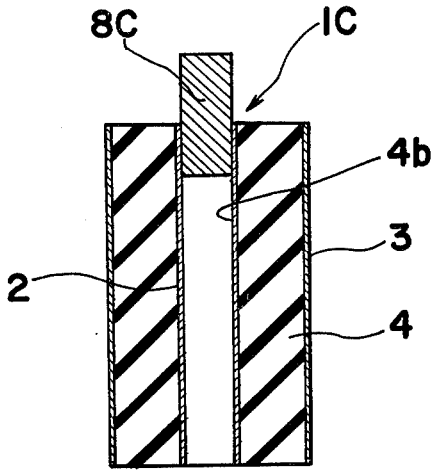

Referring to FIG. 3, there is shown another modification of the resonator of FIG. 1. In the modified resonator 1C of FIG. 3, the central rod 5 described as employed in the resonator 1 of FIG. 1 is dispensed with, and a terminal electrode 8C of metallic rod material is inserted partway into the hollow interior of the inner conductor 2 and connected mechanically and electrically thereto. It should be noted that the terminal electrode 8C may be replaced by a dielectric member formed thereon with an electrode film (not shown).

Since other construction and effects of the modified resonators of FIGS. 2 and 3 are generally similar to those of the resonator of FIG. 1, detailed description thereof is abbreviated for brevity.

In the branching filter according to the present invention, there are employed coaxial resonators as described in the foregoing, i.e. the coaxial TEM resonator having the dielectric member disposed between the inner conductor and outer conductor, and the terminal electrode member secured to and in direct electrical contact with the inner conductor so that one portion of the terminal electrode member projects from one end of the coaxial resonator.

Figure 4:
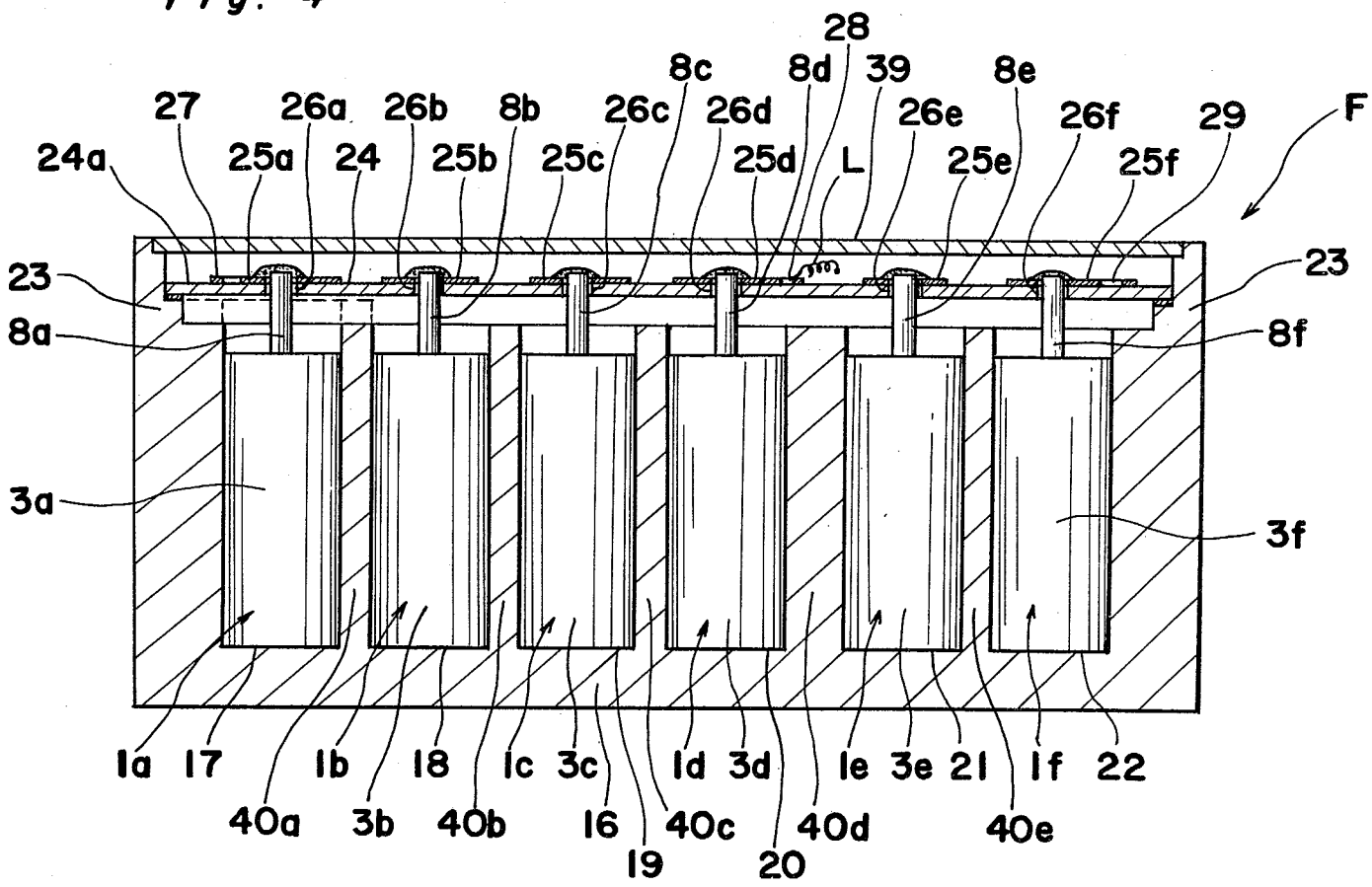
FIG. 4 is a side elevational view, partly in section, of a branching filter according to one preferred embodiment of the present invention.

Referring to FIG. 4, there is shown a branching filter F according to one preferred embodiment of the present invention. The filter F includes a casing 16 of electrically conductive material, for example, of duralumin having a cubic rectangular configuration and provided with bores or vertical cavities 17, 18, 19, 20, 21 and 22 formed therein in laterally spaced and parallel relation to each other as shown in FIG. 4. In these cavities 17, 18, 19, 20, 21 and 22, there are respectively incorporated, for example, six ¼ wavelength coaxial TEM resonators 1*a*, 1*b*, 1*c*, 1*d*, 1*e* and 1*f* each secured thereat so that the outer conductors 3*a*, 3*b*, 3*c*, 3*d*, 3*e* and 3*f* thereof are electrically connected to the casing 16. Each of the resonators 1*a*, 1*b*, 1*c*, 1*d*, 1*e* and 1*f* is fixed to the casing 16, for example, with electrically conductive adhesive for securing them and electrically connecting them to the casing 16. Alternatively, the resonators 1*a* to 1*f* may be secured in the cavities 17 to 22 with securing screws (not shown). In the upper inner surface of the casing 16 above the resonators 1*a* to 1*f* in FIG. 4, there are formed stepped portions 23 on which a dielectric material plate member, for example a ceramic plate 24, is mounted. On the main or upper flat surface 24*a* of the ceramic plate 24*a* which lies in a plane at right angles with respect to the axes of the terminal members of the resonators 1*a* to 1*f*, electrode films or layers 25*a*, 25*b*, 25*c*, 25*d*, 25*e* and 25*f* are formed in positions corresponding to the resonators 1*a* to 1*f*. Layers 25*a* to 25*f* may have various shapes and dimensions, for example a square configuration as shown. See FIG. 5. The electrode layers 25*a*, 25*b*, 25*c*, 25*d*, 25*e* and 25*f* are respectively formed with openings 26*a*, 26*b*, 26*c*, 26*d*, 26*e* and 26*f* also extending through the ceramic plate 24, into which openings 26*a* to 26*f*, the terminal members 8*a*, 8*b*, 8*c*, 8*d*, 8*e* and 8*f* of the resonators 1*a* to 1*f* are inserted so as to be respectively connected to the electrode layers 25*a* to 25*f*. The electrode layer 25*a* is coupled with an external coupling electrode layer 27, and the electrode layers 25*d* and 25*e* are coupled with a common external coupling electrode layer 28, while the electrode layer 25*f* is coupled with an external coupling electrode layer 29 as is most clearly seen in FIG. 5. The external coupling electrode layers 27, 28 and 29 are respectively connected to corresponding external terminals 30, 31 and 32 electrically insulated from the casing 16 and extending laterally and outwardly from one side wall or a bottom wall 16*a* of the casing 16. Ground terminals 33, 34 and 35, and 36 electrically connected to the casing 16 are respectively provided adjacent to the external terminals 30, 31 and 32. On the bottom wall 16*a* of the casing 16 at its corner portions remote from the corner portions where the terminals 33 and 36 are provided, other ground terminals 37 and 38 extend outwardly in the same direction as that of the terminals 33 and 36 so as to be electrically connected to the casing 16 (FIG. 6). Accordingly, by the construction of FIGS. 4 and 6 as described above, it is possible to directly mount the filter F onto a strip line substrate (not shown). The filter F further includes a matching coil L for matching purpose disposed at the branching portion and connected between the common external coupling electrode layer 28 and the casing 16, and consequently, the ground, and also a cover plate 39 for the casing 16.

In the above arrangement, signal transmission between the respective resonators 1*a* to 1*f* and application or deriving of signals to or from said resonators are effected through electrostatic capacitive coupling, the degree of coupling of which is mainly determined by the configurations and dimensions of the electrode layers 25*a* to 25*f* mentioned earlier. Meanwhile, the band pass width is also determined by the height of partition walls 40*a*, 40*b*, 40*c*, 40*d* and 40*e* defined between the cavities 17, 18, 19, 20, 21 and 22 in the casing 16. For example, in order to subject the resonators 1*a* and 1*b* to narrow band coupling, the height of the partition wall 40*a* is increased as shown by dotted lines in FIG. 4. In contrast, to subject the resonators 1*a* and 1*b* to wide band coupling, the height of the partition wall 40*a* is decreased. The band pass width for other portions may be determined in a similar manner to the above. Therefore, in the arrangement described above, it may be considered that there are present one filter F1 (passing central frequency f1) constituted by the resonators 1*a* to 1*d* and the other filter F2 (passing central frequency f2) constituted by the resonators 1*e* and 1*f*, and of the signal component applied between the terminal 31 and the ground, the signal with a central frequency f1 is derived from between the terminal 30 and the ground, while the signal with a central frequency f2 is taken from between the terminal 32 and the ground. In contrast, the signal with the central frequency f1 applied between the terminal 30 and the ground is derived from between the terminal 31 and the ground, while the signal with the central frequency f2 applied between the terminal 32 and the ground is taken from between the terminal 31 and the ground.

Figure 5:
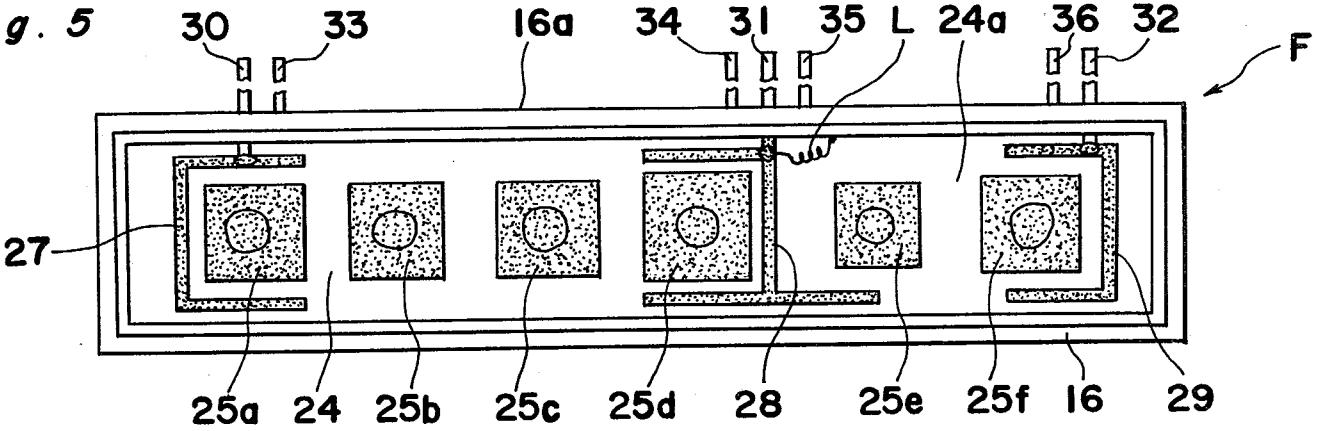
FIG. 5 is a top plan view of the filter of FIG. 4, with the upper cover for a casing removed for clarity.
Figure 6:
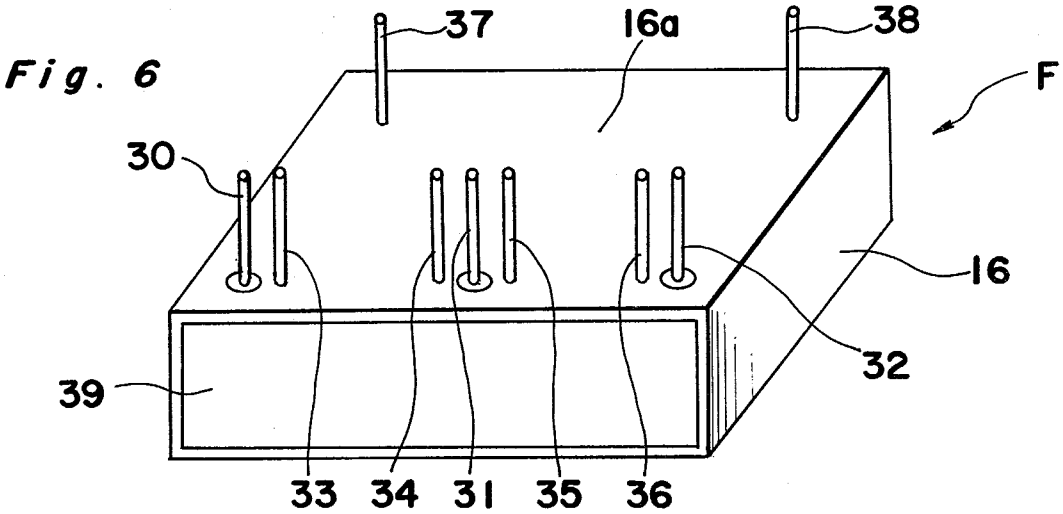
FIG. 6 is a perspective view of the filter of FIG. 4 as viewed from the bottom portion thereof.
Figure 7:
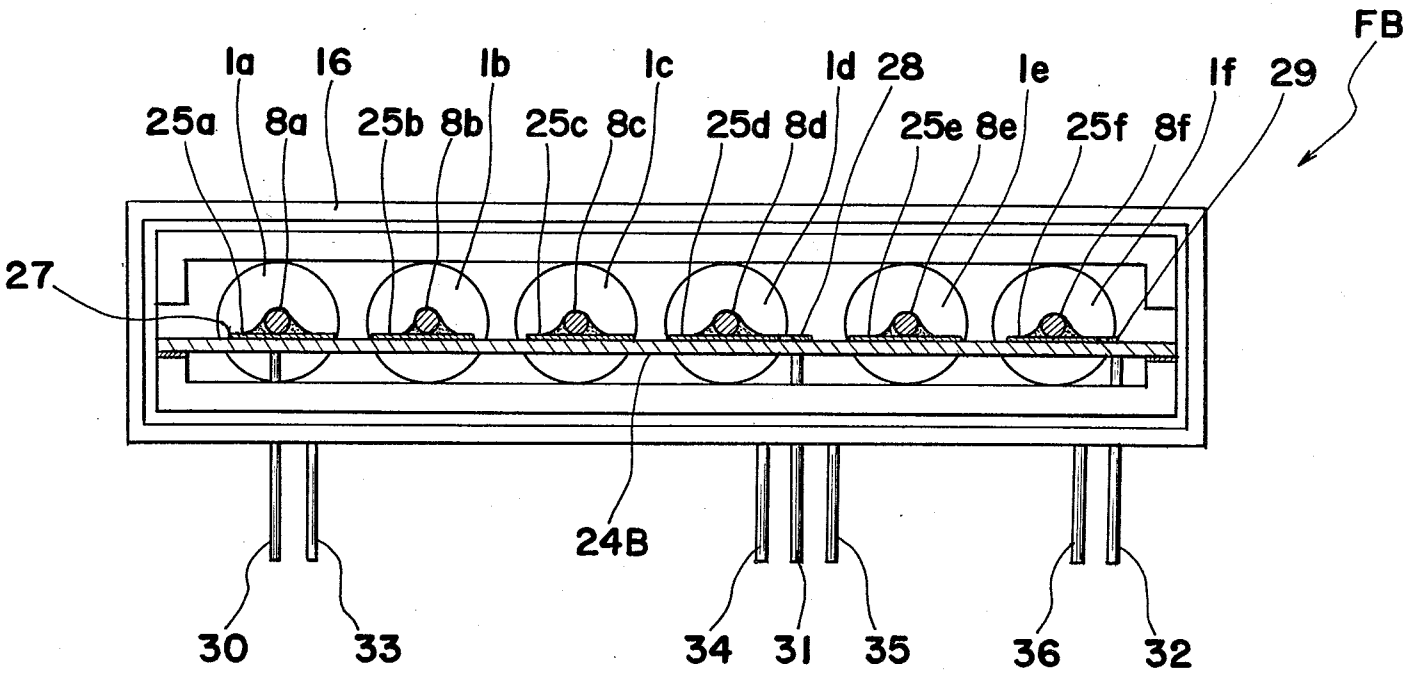
FIG. 7 is a view similar to FIG. 5, but particularly shows a modification thereof.
Figure 8:
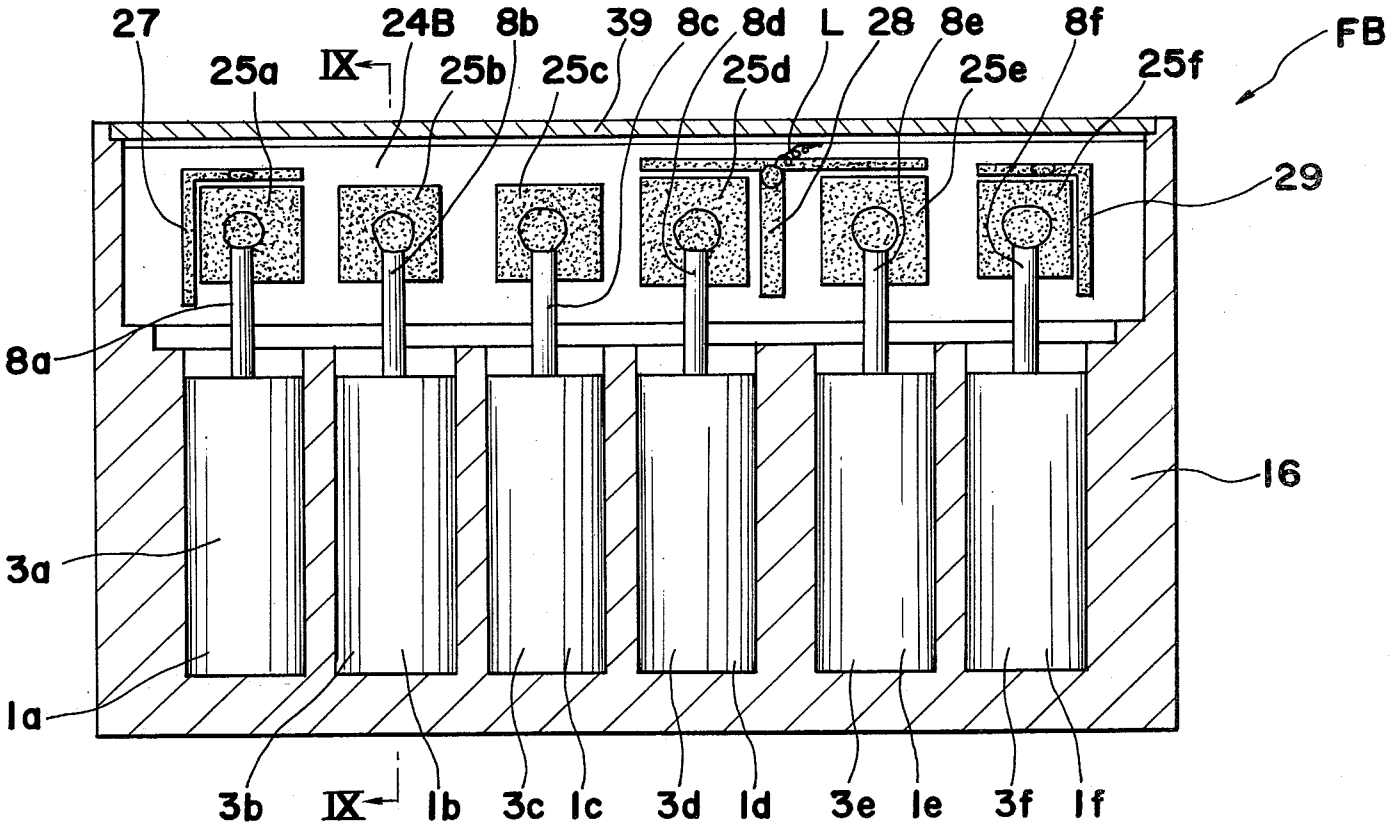
FIG. 8 is a side elevational view, partly in section, of the branching filter of FIG. 7.
Figure 9:
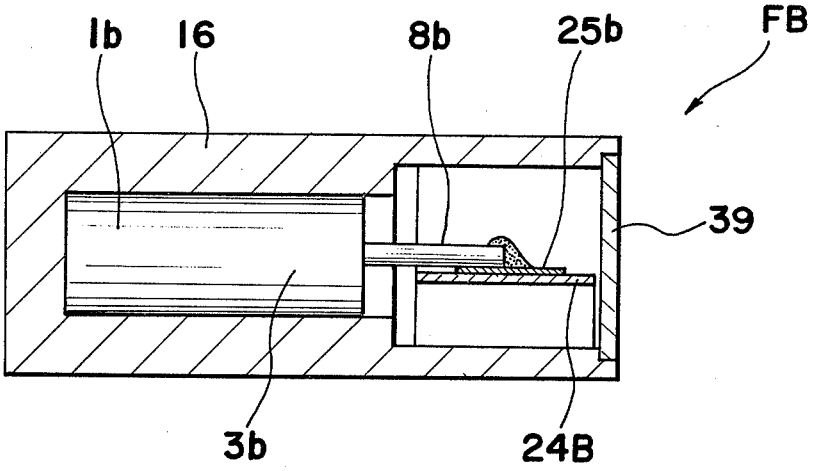
FIG. 9 is a partially sectional view taken along the line IX—IX in FIG. 8.
Figure 10:
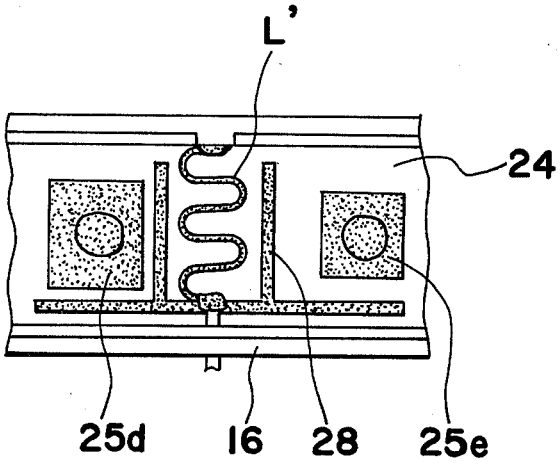
FIG. 10 is a fragmentary top plan view of a branching filter according to another modification of the present invention, with the upper cover for the casing removed for clarity.

Referring to FIGS. 7, 8 and 9, there is shown a modification of the branching filter F of FIGS. 4 to 6. In the modified filter FB of FIGS. 7 to 9, the ceramic plate 24 described lying in a plane intersecting or at right angles with respect to the axial direction of each of the terminal members 8*a* to 8*f* of the resonators 1*a* to 1*f* is replaced by a ceramic plate 24B lying in a plane parallel to the axis of the terminal member of each of said resonators 1*a* to 1*f*, with minor alterations in the configurations of the external coupling electrode layers 27, 28 and 29 and in the connections between the terminal members 8*a* to 8*f* and the electrode layers 25*a* to 25*f* as shown in FIG. 8. Since other constructions and effect of the modified branching filter FB are generally similar to those of the filter F of FIGS. 4 to 6, detailed description thereof is abbreviated here, with like parts being designated by like reference numerals. As described above, the ceramic plate 24, and consequently the electrode layers 25*a* to 25*f* and external coupling electrode layers 27, 28 and 29 may be directed in the direction either intersecting or parallel to the axes of the terminal members 8*a* to 8*f* of the resonators 1*a* to 1*f*. It is to be noted here that the main feature of the present invention resides in that the coupling electrodes 25*a* to 25*f*, and 27, 28 and 29, etc. are formed on the ceramic plate 24 of flat plate-like configuration for necessary coupling with the respective resonators 1*a* to 1*f* and external terminals 30 to 38. It should also be noted that, for the matching coil L, ordinary separate part or discrete part may be employed, but depending on necessity such a matching coil may be provided on the ceramic plate 24 through known printing process as shown at L' in FIG. 10, and that if it is possible to achieve proper matching without use of such a matching coil, the matching coil L need not necessarily be employed.

In the foregoing embodiments, although the description is mainly related to the branching filters to be inserted into strip lines, the present invention is not limited in its application to the filters for the strip lines, but may readily be applicable to electrical filters for waveguides and coaxial lines through addition of proper conversion circuits thereto.

Furthermore, the arrangement in the foregoing embodiments in which the ¼ wavelength coaxial TEM resonators are accommodated in the cylindrical bores may be so modified, for example, as to accommodate the resonators in grooves or recesses having semicircular cross section (not shown).

Moreover, it is to be noted that, the present invention is not limited in its application to the ¼ wavelength coaxial TEM resonators alone described in the foregoing embodiments, but may be applicable to ½ wavelength TEM resonators or the like depending on necessity.

As is clear from the foregoing description, in the arrangement according to the present invention, it is so arranged that the coupling electrodes are formed on the flat plate-like ceramic plate for coupling with the respective resonators and external terminals, and therefore, the number of parts required for the manufacture is appreciably reduced as compared with the conventional arrangements, while, owing to the simple construction, no particular skill is required in the processing for the production of the microwave device. Accordingly, microwave devices such as electrical filters, branching filters, etc. with simple structure and compact size can be readily available on a large scale at low cost.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A microwave device, comprising:

an electrically conductive housing means, said housing means being a casing member of a substantially parallelepiped configuration and having a plurality of cavities formed therein;

a plurality of resonator means equal in number to the number of said cavities, a different said resonator means being accommodated in each said cavity, each of said resonator means being mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electrical contact with said inner conductor member, one portion of said terminal electrode member projecting from one end of said resonator means;

an input means for applying electrical signals to said microwave device;

an output means for removing electrical signal from said microwave device;

a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers; and said cavities of said casing member being separated by partition walls, each of said partition walls having a predetermined height which determines the band pass width of said microwave device.

2. A microwave device as claimed in claim 1, wherein each of said cavities of said casing member is a cylindrical bore having a circular cross section for accommodating therein a said resonator means.

3. A microwave device as claimed in claim 1, wherein each of a said cavities of said casing member is a recess having a semi-circular cross section for accommodating therein said resonator means.

4. A microwave device, comprising:

(A) an electrically conductive housing means;

(B) at least two resonator means accommodated in and electrically connected and mechanically secured to said housing means, each said resonator means including:

(1) a dielectric member having a bore therein;

(2) an outer conductor member disposed on the outer periphery of said dielectric member and electrically connected to said housing means;

(3) an inner conductor member disposed on the periphery of said bore of said dielectric member; and (4) a terminal electrode member secured to and in direct electrical contact with said inner conductor member, one portion of said terminal electrode member projecting from one end of said resonator means;

(C) each of said dielectric members being a cylinder having a coaxial bore formed therein, said inner and outer conductor members being formed of a metallic material of high frequency electrical conductivity and being disposed on the periphery of said cylinder and on the periphery of said coaxial bore, respectively, said terminal electrode member of each said resonator means comprising cylindrical rod member having the same length as that of said cylinder and fitted into said coaxial bore of said cylinder with its opposite ends flush with corresponding ends of said cylinder, said opposite ends being covered by electrode films which are integral with said inner conductor member, and a terminal member bonded to one of said electrode films and defining said projecting terminal portion of said terminal electrode member;

(D) an input means for applying electrical signals to said microwave device;

(E) an output means for removing electrical signal from said microwave device; and (F) a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers.

5. A microwave device, comprising:

an electrically conductive housing means;

at least two resonator means accommodated in and electrically connected and mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, a terminal electrode member secured to and in direct electrical conduct with said inner conductor member, one portion of said terminal electrode member projecting from one end of said resonator means, each of said dielectric members being a cylinder having a coaxial bore formed therein; said inner and outer conductor members being formed of a metallic material of high frequency electrical conductivity, and being disposed on the periphery of said cylinder and on the periphery of said coaxial bore, respectively; said terminal electrode member of each said resonator means comprising a central rod member having a length longer than that of said cylinder and fitted into said coaxial bore of said cylinder with one end extending therefrom and defining said projecting terminal portion and a second end flush with a corresponding end of said cylinder; said ends of said central rod member being covered by electrode films which are integral with said inner conductor member;

an input means for applying electrical signals to said microwave device;

an output means for removing electrical signals from said microwave device; and a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers.

6. A microwave device as claimed in claim 4 or 5, wherein said central rod member is formed of dielectric material.

7. A microwave device as claimed in claim 4 or 5, wherein said central rod member is formed of metallic material.

8. A microwave device, comprising:

an electrically conductive housing means;

at least two resonator means accommodated in and electrically connected and mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electric contact with said inner conductor member, one portion of said terminal electrode member projecting from one end of said resonator means; each of said dielectric members being a cylinder having a coaxial bore formed therein; said inner and outer conductor members being formed of a metallic material of high frequency electrical conductivity and being disposed on the periphery of said cylinder and on the periphery of said coaxial bore, respectively;

said terminal electrode member of each said resonator means being a central terminal rod having a length shorter than that of said cylinder and partially fitted into said coaxial bore at one end of said cylinder so as to be secured thereat to establish electrical and mechanical connection with respect to said inner conductor member performing said projecting terminal portion;

an input means for applying electrical signals to said microwave device;

an output means for removing electrical signals from said microwave device; and a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers.

9. A microwave device as claimed in claim 8, wherein said central terminal rod is made of metallic material.

10. A microwave device as claimed in claim 8, wherein said central terminal rod is made of dielectric material covered, on its surface, with electrode film.

11. A microwave device, comprising:

an electrically conductive housing means;

at least two resonator means accommodated in and electrically connected and mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electric contact with said inner conductor member, one portion of said terminal electrode member projecting from one end of said resonator means; each of said dielectric members being a cylinder having a coaxial bore formed therein; said inner and outer conductor members being formed of a metallic material of high frequency electrical conductivity and being disposed on the periphery of said cylinder and on the periphery of said coaxial bore, respectively;

an input means for applying electrical signals to said microwave device;

an output means fore removing electrical signals from said microwave device;

a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers;

said dielectric coupling member comprising a flat plate-like member having said coupling electrode layers formed on its one main flat surface, said one main flat surface and said coupling electrode layers formed thereon lying in a plane intersecting the longitudinal axis of said terminal electrode members of said resonator means; and a plurality of external coupling electrode layers and a common external coupling electrode layer provided on said one main flat surface of said flat plate-like member in positions adjacent to said coupling electrode layers, and connected to said input and output means, and a means for branching being provided between said common external coupling electrode layer and said casing member, said branching means being associated with a matching coil separately connected between said common external coupling electrode layer and said casing layer.

12. A microwave device, comprising:

an electrically conductive housing means;

at least two resonator means accommodated in and electrically connected and mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electric contact with said inner conductor member, one portion of said terminal electrode member projecting from one end of said resonator means; each of said dielectric members being a cylinder having a coaxial bore formed therein; said inner and outer conductor members being formed of a metallic material of high frequency electrical conductivity and being disposed on the periphery of said cylinder and on the periphery of said coaxial bore, respectively;

an input means for applying electrical signals to said microwave device;

an output means fore removing electrical signals from said microwave device;

a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers;

said dielectric coupling member comprising a flat plate-like member having said coupling electrode layers formed on its one main surface, said one main surface and said coupling electric layers formed thereon lying in a plane parallel to the longitudinal axis of said terminal electrode members of said resonator means;

a plurality of external coupling electrode layers and a common external coupling electrode layer provided on said one main flat surface of said flat plate-like member in positions adjacent to said coupling electrode layers, and connected to said input and output means; and branching means provided between said common external coupling electrode layer and said casing member, said branching means being associated with a matching coil separately connected between said common external coupling electrode layer and said casing member.

13. A microwave device, comprising:

an electrically conductive housing means;

at least two resonator means accommodated in and electrically connected and mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electric contact with said inner conductor member, one portion of said terminal electrode member projecting from one end of said resonator means; each of said dielectric members being a cylinder having a coaxial bore formed therein; said inner and outer conductor members being formed of a metallic material of high frequency electrical conductivity and being disposed on the periphery of said cylinder and on the periphery of said coaxial bore, respectively;

an input means for applying electrical signals to said microwave device;

an output means fore removing electrical signals from said microwave device;

a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers;

said dielectric coupling member comprising a flat plate-like member having said coupling electrode layers formed on its one main flat surface, said one main flat surface and said coupling electrode layers formed thereon lying in a plane intersecting the longitudinal axis of said terminal electrode members of said resonator means; and a plurality of external coupling electrode layers and a common external coupling electrode layer provided on said one main flat surface of said flat plate-like member in positions adjacent to said coupling electrode layers, and connected to said input and output means, and a means for branching being provided between said common external coupling electrode layer and said casing member, said branching means being a matching coil printed on said flat plate-like member for connection between said common external coupling electrode layer and said casing member.

14. A microwave device, comprising:

an electrically conductive housing means;

at least two resonator means accommodated in and electrically connected and mechanically secured to said housing means, each of said resonator means including a dielectric member having a bore therein, an outer conductor member disposed on the outer periphery of said dielectric member and electrically connected to said housing means, an inner conductor member disposed on the periphery of said bore of said dielectric member, and a terminal electrode member secured to and in direct electric contact with said inner conductor member, one portion of said terminal electrode member projecting from one end of said resonator means; each of said dielectric members being a cylinder having a coaxial bore formed therein; said inner and outer conductor members being formed of a metallic material of high frequency electrical conductivity and being disposed on the periphery of said cylinder and on the periphery of said coaxial bore, respectively;

an input means for applying electrical signals to said microwave device;

an output means fore removing electrical signals from said microwave device;

a coupling means for electrically coupling said input means, said resonator means and said output means, said coupling means including a dielectric coupling member connected between said input and output means and having thereon at least two coupling electrode layers which are spaced predetermined intervals from each other and to which the respective ones of said projecting terminal portions of said terminal electrode members are connected for establishing electrostatic capacitive coupling between said coupling electrode layers;

said dielectric coupling member comprising a flat plate-like member having said coupling electrode layers formed on its one main surface, said one main surface and said coupling electric layers formed thereon lying in a plane parallel to the longitudinal axis of said terminal electrode members of said resonator means;

a plurality of external coupling electrode layers and a common external coupling electrode layer provided on said one main flat surface of said flat plate-like member in positions adjacent to said coupling electrode layers, and connected to said input and output means; and branching means provided between said common external coupling electrode layer and said casing member, said branching means being a matching coil printed on said flat plate-like member for connection between said common external coupling electrode layer and said casing member.

* * * * *